US009353715B2

(12) United States Patent
Rogler et al.

(10) Patent No.: US 9,353,715 B2
(45) Date of Patent: May 31, 2016

(54) FUEL INJECTOR

(71) Applicants: Philipp Rogler, Stuttgart (DE); Martin Scheffel, Vaihingen (DE)

(72) Inventors: Philipp Rogler, Stuttgart (DE); Martin Scheffel, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/408,497

(22) PCT Filed: May 24, 2013

(86) PCT No.: PCT/EP2013/060761
§ 371 (c)(1),
(2) Date: Dec. 16, 2014

(87) PCT Pub. No.: WO2013/189690
PCT Pub. Date: Dec. 27, 2013

(65) Prior Publication Data

US 2015/0152822 A1 Jun. 4, 2015

(30) Foreign Application Priority Data

Jun. 20, 2012 (DE) ..... 10 2012 210 415

(51) Int. Cl.
*F02M 51/06* (2006.01)
*F02M 61/20* (2006.01)
*F02M 63/00* (2006.01)

(52) U.S. Cl.
CPC ..... *F02M 51/0685* (2013.01); *F02M 51/0625* (2013.01); *F02M 51/0628* (2013.01); *F02M 51/0671* (2013.01); *F02M 61/20* (2013.01); *F02M 63/0075* (2013.01)

(58) Field of Classification Search
CPC ..... F02M 51/061; F02M 51/0625; F02M 51/0628; F02M 51/0685; F02M 61/20
See application file for complete search history.

(56) References Cited

U.S. PATENT DOCUMENTS

| | | | | |
|---|---|---|---|---|
| 3,871,615 | A * | 3/1975 | Donner | 251/129.19 |
| 6,450,424 | B1 * | 9/2002 | Horbelt | 239/585.1 |
| 6,799,734 | B1 * | 10/2004 | Hans | 239/585.1 |
| 7,819,344 | B2 * | 10/2010 | Abe et al. | 239/585.2 |
| 2002/0063173 | A1 * | 5/2002 | Spakowski et al. | 239/585.1 |
| 2003/0155440 | A1 * | 8/2003 | Reiter | 239/533.2 |
| 2003/0160117 | A1 * | 8/2003 | Stier | 239/585.1 |
| 2004/0050977 | A1 * | 3/2004 | Rieger et al. | 239/585.1 |
| 2012/0101707 | A1 * | 4/2012 | Kemmer et al. | 701/103 |

FOREIGN PATENT DOCUMENTS

| | | |
|---|---|---|
| DE | 101 08 945 | 9/2002 |
| DE | 10 2004 024533 | 12/2005 |

OTHER PUBLICATIONS

International Search Report for PCT/EP2013/060761, dated Aug. 6, 2013.

* cited by examiner

*Primary Examiner* — Ryan Reis
(74) *Attorney, Agent, or Firm* — Norton Rose Fulbright US LLP

(57) ABSTRACT

A fuel injector for injecting fuel into an internal combustion engine includes: a housing having at least one spray orifice; a magnet armature movable linearly in the housing; a magnetic coil acting magnetically on the magnet armature; and a valve element movable linearly with respect to the housing and with respect to the magnet armature, the valve element, together with the at least one spray orifice, forming a valve seat, a first stop on the valve element, and a tension spring pulling the magnet armature against the first stop.

10 Claims, 4 Drawing Sheets

Stand der Technik

FUEL INJECTOR

BACKGROUND OF THE INVENTION

1. Field of the Invention

The present invention relates to a fuel injector, particularly for injecting fuel into an internal combustion engine.

2. Description of the Related Art

The related art knows fuel injectors, among other things, for the direct injection of Otto fuel, using a valve needle which is moved by an actuator against a closing spring in such a way that a desired fuel quantity is inserted directly into the combustion chamber in a quantitatively regulated manner. In this context, in a solenoid valve, the magnet armature may be decoupled from the valve needle, so that the valve needle group has an armature free path. Such a known fuel injector 100 is shown in FIG. 5. Known fuel injector 100 has an housing 102 and a valve needle 101 situated on housing 102.

Valve needle 101 is lodged in a magnet armature 104. Magnet armature 104 is moved via a magnetic coil 103. A spring cup 105 is fastened on magnet armature 104. A pressure spring 107 is supported at one end on a sleeve 106 mounted firmly on valve needle 101. The other end of pressure spring 107 is supported on spring cup 105. Pressure spring 107 has the effect that magnet armature 104 lies against sleeve 106. That is, magnet armature 104 is pressed by pressure spring 107 into the at-rest position. Spring cup 105 transmits the force of pressure spring 107 to magnet armature 104.

BRIEF SUMMARY OF THE INVENTION

The fuel injector according to the present invention uses a tension spring in order to pull the magnet armature into its at-rest position on a stop on the valve element. According to the present invention, the two-mass system made up of magnet armature and valve element does not require a spring cup. This reduces the number of components. Furthermore, it reduces the number of welding seams, since no spring cup is fastened any longer and thus the production of the fuel injector is also simplified. The tension spring used according to the present invention no longer has to be ground at its end face, as the known pressure spring did, whereby the individual parts cost for the spring is reduced. Moreover, the mass of the magnet armature group is reduced, since the spring cup is omitted. The valve dynamics improved by this reduce the noise behavior of the valve. All these advantages are achieved by the fuel injector according to the present invention, particularly for injecting fuel into an internal combustion engine, including a housing having at least one spray orifice and a magnet armature that is movable linearly in the housing. A magnetic coil, that is able to have current applied to it, acts on the magnet armature. In addition, a pole body may still be provided in the housing. In the housing, a linearly movable valve element is provided, for opening and closing the spray orifice. The valve element is movable linearly, both with respect to the housing and with respect to the magnet armature. A first stop is developed on the valve element. A tension spring is provided which pulls the magnet armature against the first stop. According to its definition, a tension spring is subject to tension and contracts again by itself.

The magnet armature is preferably guided on the valve element. The valve element itself is preferably composed of a valve needle, which acts upon a valve ball. The magnet armature is situated on the valve needle and is movable with reference to the valve needle.

The tension spring is developed to be radially clamping, in particular. Because of that, a secure connection of the ends of the tension spring to the magnet armature and the valve element is possible. It is particularly provided that a first end of the tension spring is directly connected to the magnet armature, and a second end of the tension spring is directly connected to the first stop. This first stop is developed as a sleeve connected firmly to the valve element, in particular.

There are various embodiments for the exact connection between the tension spring and the magnet armature, and between the tension spring and the valve element. These various embodiments may also be combined among one another.

Thus it is particularly provided that a first contact surface facing away from the combustion chamber be developed on the magnet armature. The tension spring is able to lie with one end against this first contact surface.

Furthermore, it is provided that, on the valve element, especially on the sleeve that forms the first stop, there is developed a second contact surface facing the combustion chamber. The tension spring is able to lie with its other end against this second contact surface.

An encircling groove is preferably developed on the first and/or on the second contact surface. The ends of the spring are able to be accommodated in these grooves in a form-locking manner. In particular, these grooves are semicircular, so that the wire of a spiral-shaped spring is able to be accommodated in them with form locking.

The first contact surface on the magnet armature is formed particularly preferably by a recess in the magnet armature.

The magnet armature thus has a shoulder pointing radially inwards, on which the first contact surface is developed. Thereby the mass of the magnet armature is reduced, and consequently the valve dynamics and the noise development are improved. The recess on the magnet armature is shaped so that the magnetic flux from the magnetic coil and the internal pole through the magnet armature is influenced only insubstantially, and therefore the magnetic force is reduced only insubstantially.

In addition or alternatively to the contact of the tension spring on the first and/or the second contact surface, a connection in one material of the tension spring to the magnet armature and/or to the valve element is provided. The tension spring is welded, in particular.

The tension spring is particularly developed as a self-contracting spiral spring.

Furthermore, a closing pressure spring is provided which acts upon the valve element in the closing direction. This closing pressure spring acts against an additional sleeve on the valve element. The magnet armature is preferably situated on the valve element between the sleeve forming the first stop and the additional sleeve.

DETAILED DESCRIPTION OF THE INVENTION

Figure 1:
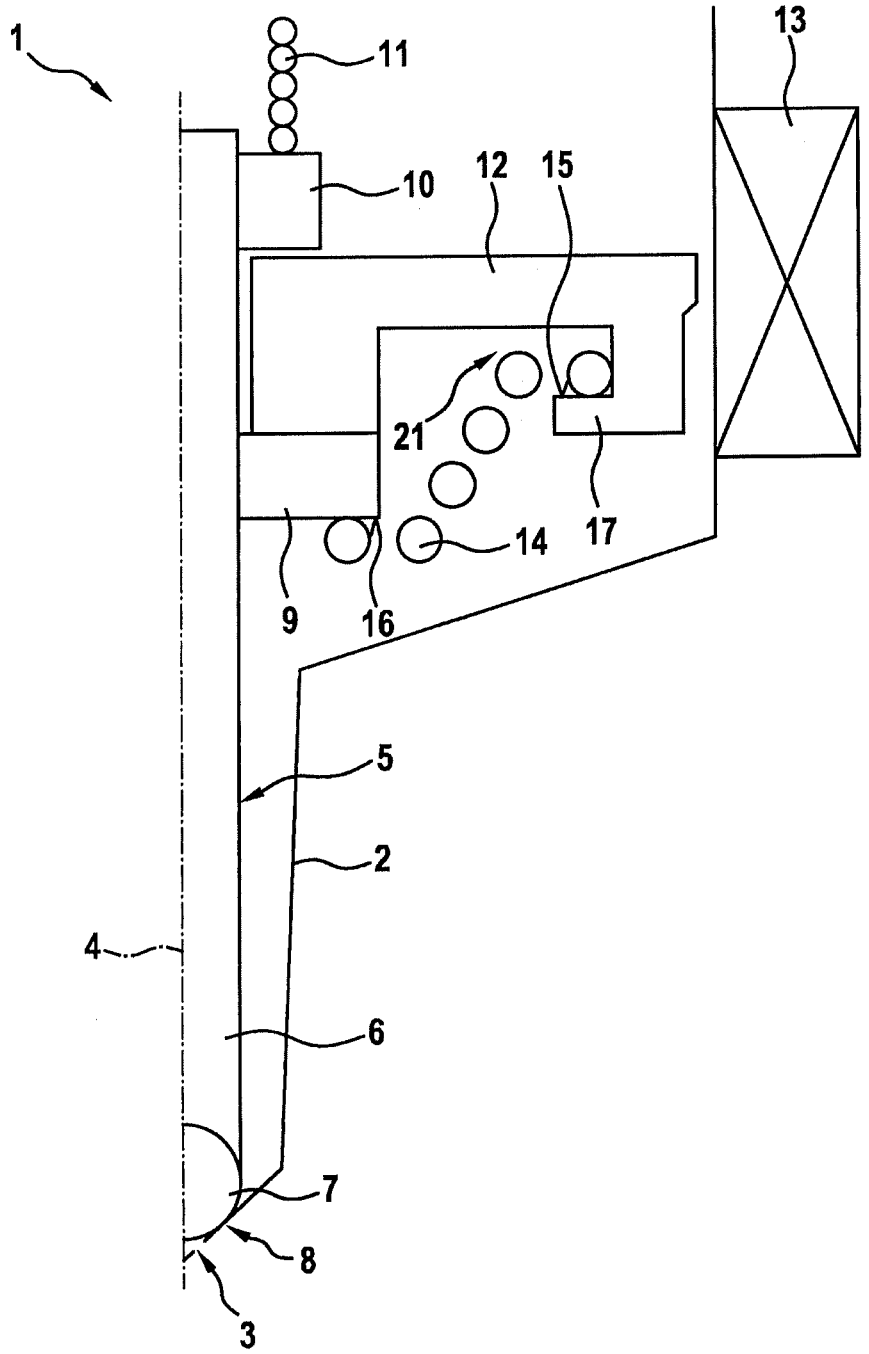
FIG. 1 shows a fuel injector according to the present invention, according to a first exemplary embodiment.

FIG. 1 shows a half section of a fuel injector 100 according to the first exemplary embodiment. The illustration is schematically simplified. In particular, only an housing 2 of fuel injector 1 is indicated.

In housing 2, a valve element 5 extends along a longitudinal axis 4. Valve element 5 includes a valve needle 6, which acts upon a valve ball 7. A spray orifice 3 is developed in housing 2 on the side of housing 2 facing the combustion chamber. Fuel is able to be injected into a combustion chamber via this spray orifice 3 from the interior of housing 2. In the lower region of housing 2, valve ball 7 of valve element 5 forms a valve seat 8 for sealing spray orifice 3.

On valve element 5, especially on valve needle 6, a first stop 9, developed as a first sleeve, is fastened. Moreover, on valve needle 6 a second stop 10 is located, developed as a second sleeve. The first and/or second sleeve may be mounted firmly on valve needle 6 as separate components. Alternatively, one of the two sleeves may be produced integrally with valve needle 6. A closing pressure spring 11 engages on second stop 10 and presses valve element 5 in the closing direction.

Between first stop 9 and second stop 10, a magnet armature 12 is mounted on valve needle 6. Magnet armature 12 is linearly movable with respect to valve element 5, between first stop 9 and second stop 10, along longitudinal axis 4. Furthermore, a magnetic coil 13 is provided which acts magnetically on magnet armature 12, and thus sets magnet armature 12 in motion.

Magnet armature 12 drives long valve element 5 via first stop 9 and second stop 10, so that valve element 5 is also moved along longitudinal axis 4.

A radially clamping tension spring 14 is situated between first stop 9 and magnet armature 12. This tension spring 14 draws magnet armature 12 onto first stop 9. Consequently, tension spring 14 may also be designated as an armature free path spring.

A recess 21 is provided in magnet armature 12. Because of this recess 21, a shoulder 17 pointing radially inwards is developed on magnet armature 12. On this shoulder 17, a first contact surface 15 is developed facing away from the combustion chamber. A first end of tension spring 14 lies against this first contact surface 15.

A side of first stop 9, facing the combustion chamber, is designated as second contact surface 16. The other end of tension spring 14 lies against this second contact surface 16.

That is, according to the present invention, no pressure spring is provided as armature free path spring. Accordingly, no spring cup is required as in the related art. This reduces the number of components, and as a result, also the weight and the production costs for fuel injector 1 according to the present invention.

Figure 2:
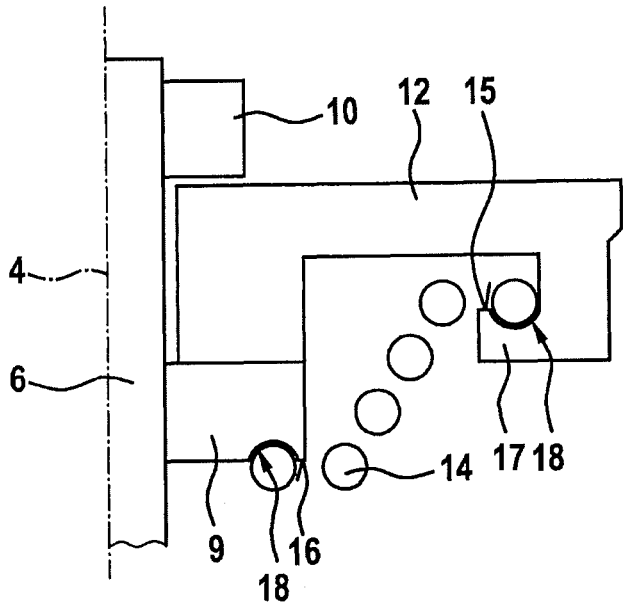
FIG. 2 shows a detail of a fuel injector according to the present invention according to a second exemplary embodiment.
Figure 3:
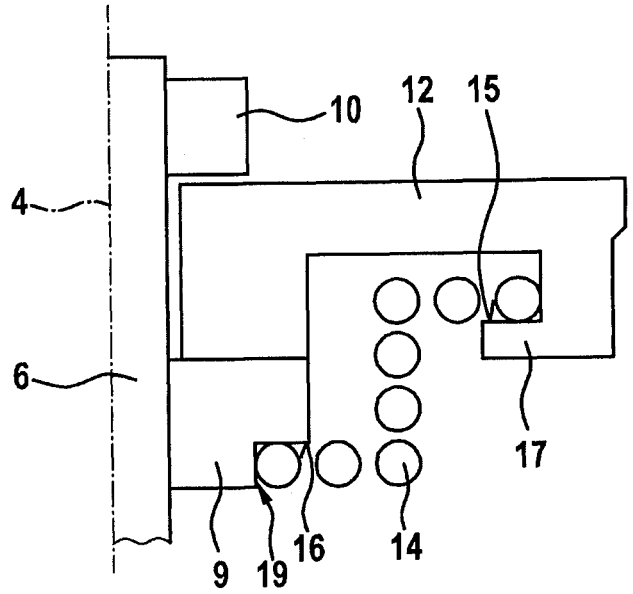
FIG. 3 shows a detail of a fuel injector according to the present invention according to a third exemplary embodiment.
Figure 4:
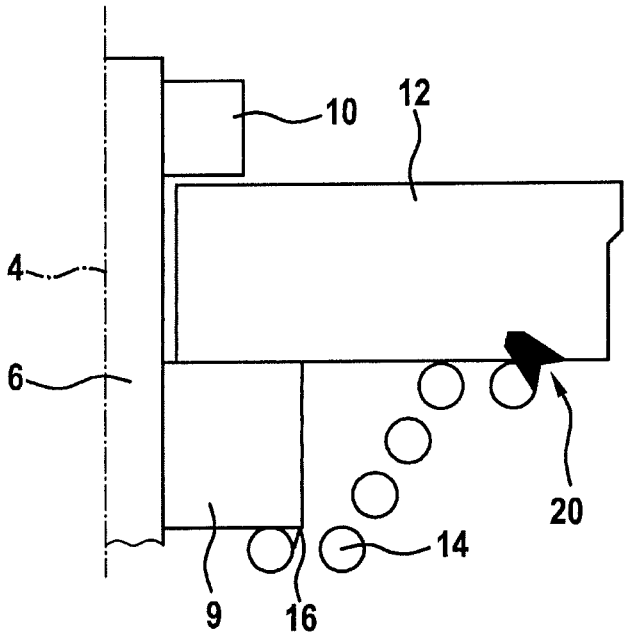
FIG. 4 shows a detail of a fuel injector according to the present invention according to a fourth exemplary embodiment.
Figure 5:
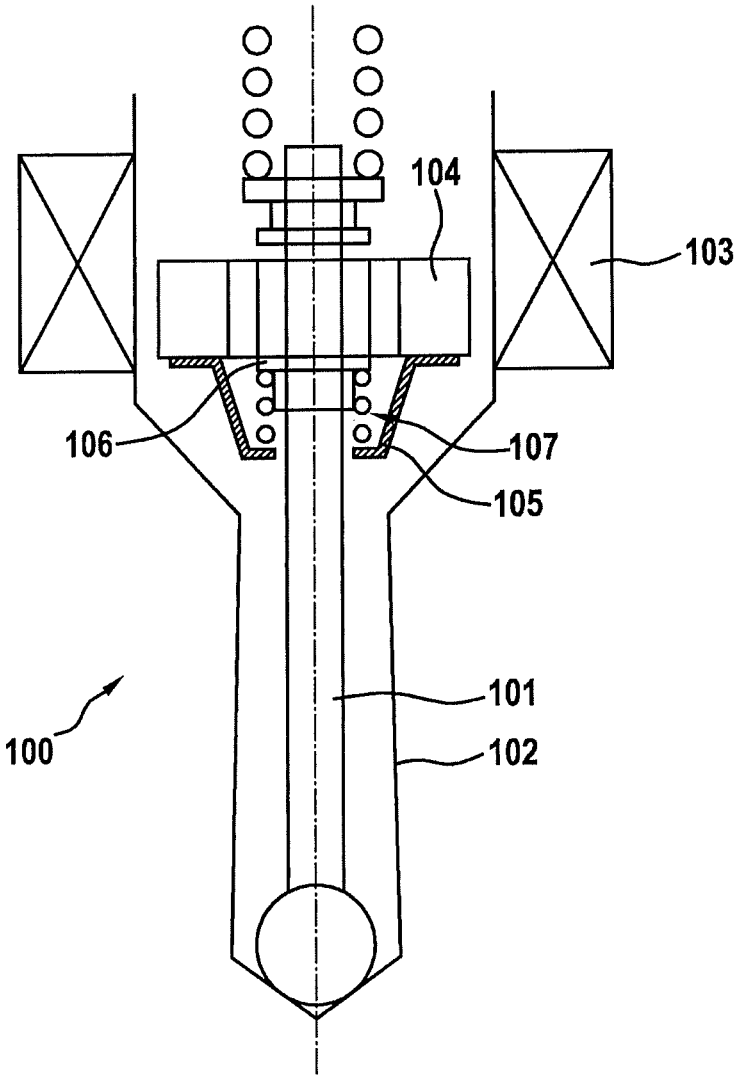
FIG. 5 shows a fuel injector according to the related art.

Additional exemplary embodiments of fuel injector 1 are explained in the following text. Identical components or functionally identical components are designated by identical reference symbols in the exemplary embodiments. FIGS. 2 to 4 show only a detail of the respective fuel injector 1.

FIG. 2 shows fuel injector 1 according to the second exemplary embodiment. In the second exemplary embodiment, in each of first contact surface 15 and second contact surface 16 an encircling groove 18 is provided. The contour of groove 18 corresponds to the ends of tension spring 14. In the example shown, tension spring 14 is developed as a spiral spring. Accordingly, tension spring 14 is developed using a bent wire having a round cross section. Grooves 18 have a corresponding semicircular cross section. Grooves 18 accommodate tension spring 14 in a form-locking manner.

FIG. 3 shows the fuel injector according to the third exemplary embodiment. In the third exemplary embodiment, an additional recess 19 is provided in first stop 9. Because of further recess 19, tension spring 14 is accommodated with form locking on first stop 9, and the slipping radially inwards of tension spring 14 is restricted.

FIG. 4 shows fuel injector 1 according to the fourth exemplary embodiment. In the fourth exemplary embodiment, a welding connection 20 is shown between tension spring 14 and magnet armature 12. Such a welding connection 20 is possible to have in all the exemplary embodiments, both between tension spring 14 and magnet armature 12 and between tension spring 14 and first stop 9.

What is claimed is:

1. A fuel injector for injecting fuel into an internal combustion engine, comprising:

a housing having at least one spray orifice;

a magnet armature movable linearly in the housing;

a magnetic coil acting magnetically on the magnet armature;

a valve element movable linearly with respect to the housing and with respect to the magnet armature, wherein the valve element forms a valve seat together with the at least one spray orifice;

a first stop provided on the valve element; and a tension spring pulling the magnet armature against the first stop.

2. The fuel injector as recited in claim 1, wherein the magnet armature is lodged on the valve element.

3. The fuel injector as recited in claim 2, wherein a first end of the tension spring is directly connected to the magnet armature, and the second end of the tension spring is directly connected to the first stop.

4. The fuel injector as recited in claim 2, wherein a first contact surface on the magnet armature faces away from the combustion chamber, and the tension spring lies against the first contact surface.

5. The fuel injector as recited in claim 4, wherein a second contact surface on the valve element faces the combustion chamber, and the tension spring lies against the second contact surface.

6. The fuel injector as recited in claim 5, wherein an encircling groove for form-locking accommodation of the tension spring is provided in at least one of the first contact surface and the second contact surface.

7. The fuel injector as recited in claim 5, wherein the tension spring is connected to at least one of the magnet armature and the valve element.

8. The fuel injector as recited in claim 5, wherein the valve element includes a valve needle, and wherein the first stop is provided on a sleeve on the valve needle.

9. The fuel injector as recited in claim 5, wherein the tension spring is a self-contracting spiral spring.

10. The fuel injector as recited in claim 5, further comprising:

a closing pressure spring acting on the valve element in the closing direction.

* * * * *